US012187515B2

(12) United States Patent
Zacherle

(10) Patent No.: US 12,187,515 B2
(45) Date of Patent: Jan. 7, 2025

(54) PACKAGE, ARTICLE CARRIER AND BLANK THEREFOR

(71) Applicant: WestRock Packaging Systems, LLC, Atlanta, GA (US)

(72) Inventor: Matthew E. Zacherle, Moseley, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 17/912,517

(22) PCT Filed: Mar. 18, 2021

(86) PCT No.: PCT/US2021/022873
§ 371 (c)(1),
(2) Date: Sep. 18, 2022

(87) PCT Pub. No.: WO2021/188751
PCT Pub. Date: Sep. 23, 2021

(65) Prior Publication Data

US 2023/0150742 A1 May 18, 2023

Related U.S. Application Data

(60) Provisional application No. 62/991,506, filed on Mar. 18, 2020.

(51) Int. Cl.
*B65D 71/40* (2006.01)

(52) U.S. Cl.
CPC .. *B65D 71/403* (2013.01); *B65D 2571/00444* (2013.01)

(58) Field of Classification Search
CPC ..... B65D 71/72; B65D 71/42; B65D 71/12
(Continued)

(56) References Cited

U.S. PATENT DOCUMENTS 4,304,329 A * 12/1981 Graser ..... B65D 5/2033 206/148
5,551,566 A * 9/1996 Sutherland ..... B65D 71/40 206/427
5,960,945 A * 10/1999 Sutherland ..... B65D 71/42 206/427

* cited by examiner

*Primary Examiner* — Anthony D Stashick
*Assistant Examiner* — Raven Collins
(74) *Attorney, Agent, or Firm* — Brian J. Goldberg; Rohini K. Garg

(57) ABSTRACT

A package, a carrier for packaging one or more articles and a blank for forming the carrier are disclosed. The carrier comprises an engaging panel with at least one article-receiving aperture disposed in engagement with a part of an article. The engaging panel has a first side edge, a first end edge, a corner defined by the first side and end edges, and a corner area. The article-receiving aperture comprises a first engaging edge across the corner area from the corner. The corner area is defined at least partially by the first engaging edge, and end portions of each of the first side and end edges extending from the corner, respectively. The corner area is folded with respect to the remainder of the engaging panel such that the end portion of the first side edge is angled with respect to an adjoining portion of the first side edge. Also disclosed is a package comprising an article carrier and at least one article, the at least one article having an upwardly tapered upper portion, the carrier comprising an engaging panel comprising a first, upper, ply and a second, lower, ply, the lower ply including at least one lower aperture having an annular series of lower ply tabs formed around the at least one lower aperture, wherein the lower ply tabs are angled upwardly with respect to the engaging panel such that the lower ply tabs are in face-contacting engagement with the upper portion of the at least one article, the upper ply includes at least one upper aperture arranged substantially coaxially with the at least one lower aperture and has an
(Continued)

annular series of upper ply tabs formed around the at least one upper aperture, the upper ply tabs are angled upwardly with respect to the engaging panel such that at least some of each of the upper ply tabs is in face-contacting engagement with a respective adjacent pair of the lower ply tabs.

20 Claims, 8 Drawing Sheets

(58) Field of Classification Search
USPC ..... 206/139–140, 147–149, 427
See application file for complete search history.

PACKAGE, ARTICLE CARRIER AND BLANK THEREFOR

TECHNICAL FIELD

The present invention relates to article top engaging devices, packages, article carriers and to blanks for forming the same. More specifically, but not exclusively, the invention relates to a carrier of the top-gripping type having one or more apertures for receiving and retaining an article therein.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide top gripping article carriers in which an aperture is formed in a panel of the carrier, wherein tabs are struck from said panel. The tabs are displaced out of the plane of said panel when an article is received in the aperture, wherein said tabs engage the article generally about a flange or lip of the article.

The present invention seeks to provide an improvement in the field of cartons, typically formed from paperboard or the like.

SUMMARY

A first aspect of the invention provides a package comprising at least one article and an article carrier. The article carrier comprises an engaging panel having at least one article-receiving aperture disposed in engagement with a part of the at least one article. The engaging panel comprises a first side edge, a first end edge, a corner defined by the first side and end edges and a corner area. The article-receiving aperture comprises a first engaging edge at a position across the corner area from the corner. The corner area is defined at least partially by the first engaging edge. An end portion of the first side edge extends from the corner and an end portion of the first end edge extends from the corner. The corner area is folded with respect to the remainder of the engaging panel such that the end portion of the first side edge is angled with respect to an adjoining portion of the first side edge.

Optionally, the end portion of the first end edge is angled with respect to an adjoining portion of the first end edge.

Optionally, the corner area is further defined at least in part by first and second fold lines, the first fold line connects the corner area with the remainder of the engaging panel, and the second fold line connects the corner area with the remainder of the engaging panel.

Optionally, the first fold line extends from the first side edge toward the at least one article-receiving aperture and the second fold line extends from the first end edge toward the at least one article-receiving aperture.

A second aspect of the invention provides a package comprising an article carrier and at least one article. The at least one article has an upwardly tapered upper portion. The carrier comprises an engaging panel comprising a first, upper, ply and a second, lower, ply. The lower ply includes at least one lower aperture having an annular series of lower ply tabs formed around the at least one lower aperture. The lower ply tabs are angled upwardly with respect to the engaging panel such that the lower ply tabs are in face-contacting engagement with the upper portion of the at least one article. The upper ply includes at least one upper aperture arranged substantially coaxially with the at least one lower aperture and has an annular series of upper ply tabs formed around the at least one upper aperture. The upper ply tabs are angled upwardly with respect to the engaging panel such that at least some of the upper ply tabs each is in face-contacting engagement with a respective adjacent pair of the lower ply tabs.

Optionally, the lower ply tabs each has a base and an inner edge opposite said base, the at least one lower aperture has a notional lower outer circle defined by the bases of lower ply tabs, the notional lower outer circle has a lower outer circle diameter. The upper ply tabs each has a base and an inner edge opposite said base of each upper ply tab, the at least one upper aperture has a notional upper outer circle defined by the bases of the upper ply tabs, the notional upper outer circle has an upper outer circle diameter. The upper outer circle diameter is equal to or less than the lower outer circle diameter.

Optionally, the at least one lower aperture has a notional lower inner circle defined by the inner edges of the lower ply tabs, the notional lower inner circle has a lower inner circle diameter. The at least one upper aperture has a notional upper inner circle defined by the inner edges of the upper ply tabs, the notional upper inner circle has an upper inner circle diameter. The upper inner circle diameter is greater than the lower inner circle diameter.

Optionally, each of the upper ply tabs is spaced apart by a recess from an adjacent one of the upper ply tabs and at least some of the recesses each is aligned with a respective one of the lower ply tabs.

A third aspect of the invention provides an article carrier for packaging one or more articles. The article carrier comprises an engaging panel comprising a first upper ply and a second lower ply secured together in face contacting arrangement. The upper ply includes at least one upper aperture having an annular series of upper ply tabs formed around the at least one upper aperture. The upper ply tabs each have a base and an inner edge opposite said base. The upper ply tabs are folded upwardly with respect to the engaging panel when a portion of at least one article is received in the at least one upper aperture. The lower ply includes at least one lower aperture substantially coaxial with the at least one upper aperture. The at least one lower aperture has an annular series of lower ply tabs formed around the at least one lower aperture. The lower ply tabs each has a base and an inner edge opposite said base. The at least one lower aperture has a notional lower outer circle defined by the bases of lower ply tabs. The notional lower outer circle has a lower outer circle diameter. The upper ply tabs each has a base and an inner edge opposite said base. The at least one upper aperture has a notional upper outer circle defined by the bases of the upper ply tabs. The notional upper outer circle has an upper outer circle diameter. The upper outer circle diameter is equal to or less than the lower outer circle diameter.

Optionally, the at least one lower aperture has a notional lower inner circle defined by the inner edges of the lower ply tabs, the notional lower inner circle has a lower inner circle diameter. The at least one upper aperture has a notional upper inner circle defined by the inner edges of the upper ply tabs, the notional upper inner circle has an upper inner circle diameter. The upper inner circle diameter is greater than the lower inner circle diameter.

Optionally, each of the upper ply tabs is spaced apart by a recess from an adjacent one of the upper ply tabs. At least some of the recesses each is aligned with a respective one of the lower ply tabs.

A fourth aspect of the invention provides a carrier for packaging at least one article. The carrier comprises an engaging panel comprising a first upper ply and a second lower ply. The lower ply includes at least one lower aperture having a series of first lower ply tabs formed around a first portion of the at least one lower aperture and at least one second lower tab formed around a second portion of the at least one lower aperture. The upper ply includes at least one upper aperture arranged substantially coaxially with the at least one lower aperture. The at least one upper aperture comprises a series of first upper ply tabs formed around a first portion of the at least one upper aperture and at least one second upper tab formed around a second portion of the at least one lower aperture. The first lower ply tabs are offset with respect to the first upper ply tabs the at least one second lower tab is aligned in registry with the at least one second upper tab.

Optionally, the first lower ply tabs are offset circumferentially with respect to the first upper ply tabs.

Optionally, a cutline which separates two adjacently disposed ones of the first lower ply tabs from each other substantially bisects one of the first upper ply tabs.

Optionally, the first lower ply tabs are offset radially with respect to the first upper ply tabs.

Optionally, inner edges of the first lower ply tabs are inset with respect to inner edges of the first upper ply tabs.

Optionally, the at least one second lower tab is aligned in registry with the at least one second upper tab so to form a common engaging edge.

Optionally, the at least one second lower tab is aligned in circumferentially and radially with respect to the at least one second upper tab.

Optionally, a first recess separates a first one of the series of first lower ply tabs from the at least one second lower tab.

Optionally, a second recess separates a second one of the series of first lower ply tabs from the at least one second lower tab.

Optionally, a third recess separates a first one of the series of first upper ply tabs from the at least one second upper tab.

Optionally, a fourth recess separates a second one of the series of first upper ply tabs from the at least one second upper tab.

A fifth aspect of the invention provides a blank for forming an article carrier. The blank comprises a first panel for forming an upper ply of an engaging panel and a second panel for forming a lower ply of the engaging panel. The second panel includes at least one lower aperture having a series of first lower ply tabs formed around a first portion of the at least one lower aperture and at least one second lower tab formed around a second portion of the at least one lower aperture. The first panel includes at least one upper aperture arranged to be substantially coaxial with the at least one lower aperture in a setup condition. The first panel has a series of first upper ply tabs formed around a first portion of the at least one upper aperture and at least one second upper tab formed around a second portion of the at least one upper aperture. The first lower ply tabs are arranged to be offset with respect to the first upper ply tabs and the at least one second lower tab is aligned in registry with the at least one second upper tab when the blank is a setup condition.

A sixth aspect of the invention provides a blank for forming an article carrier. The blank comprises an engaging panel comprising a first panel for forming an upper ply and a second panel for forming a lower ply. The second panel is hinged to the first panel for being secured together in face contacting arrangement thereto. The upper ply includes at least one upper aperture having an annular series of upper ply tabs formed around the at least one upper aperture. The upper ply tabs each have a base and an inner edge opposite said base. The upper ply tabs are foldable upwardly with respect to the engaging panel when a portion of at least one article is received in the at least one upper aperture. The lower ply includes at least one lower aperture arranged to be substantially coaxial with the at least one upper aperture in a setup condition. The at least one lower aperture has an annular series of lower ply tabs formed around the at least one lower aperture. Each of the lower ply tabs has a base and an inner edge opposite said base. The at least one lower aperture has a notional lower outer circle defined by the bases of lower ply tabs. The notional lower outer circle has a lower outer circle diameter. Each of the upper ply tabs has a base and an inner edge opposite said base. The at least one upper aperture has a notional upper outer circle defined by the bases of the upper ply tabs. The notional upper outer circle has an upper outer circle diameter. The upper outer circle diameter is equal to or less than the lower outer circle diameter.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and carriers described herein may be embodied in various and alternative forms. The Figures are not necessarily to scale and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
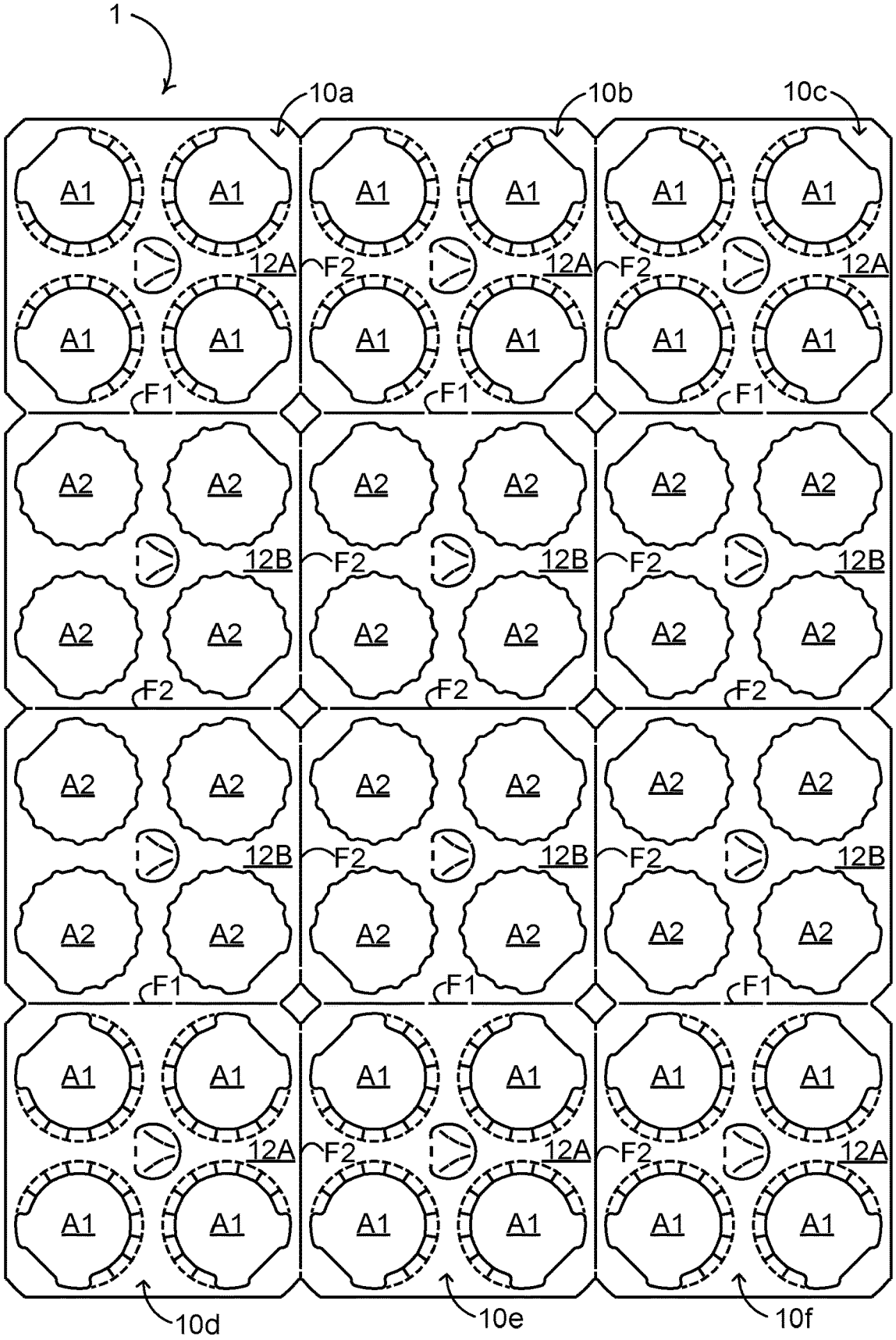
FIG. 1 is a plan view from above of a plurality of blanks, each capable of forming an article carrier according to a first embodiment, connected together in an array.
Figure 2:
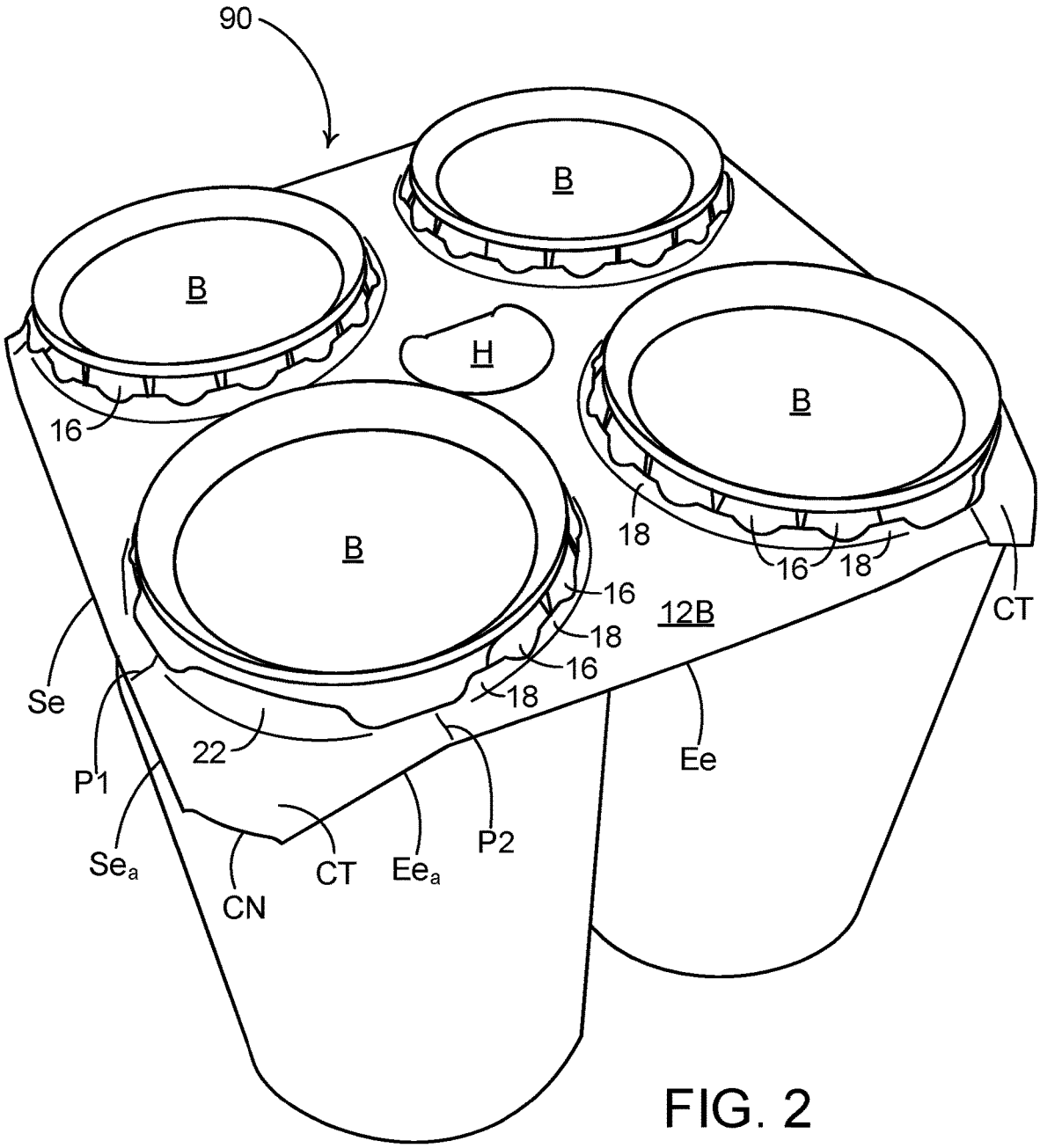
FIG. 2 is a perspective view from above of a carrier, formed from one of the blanks of FIG. 1, engaging a group of articles.
Figure 4:
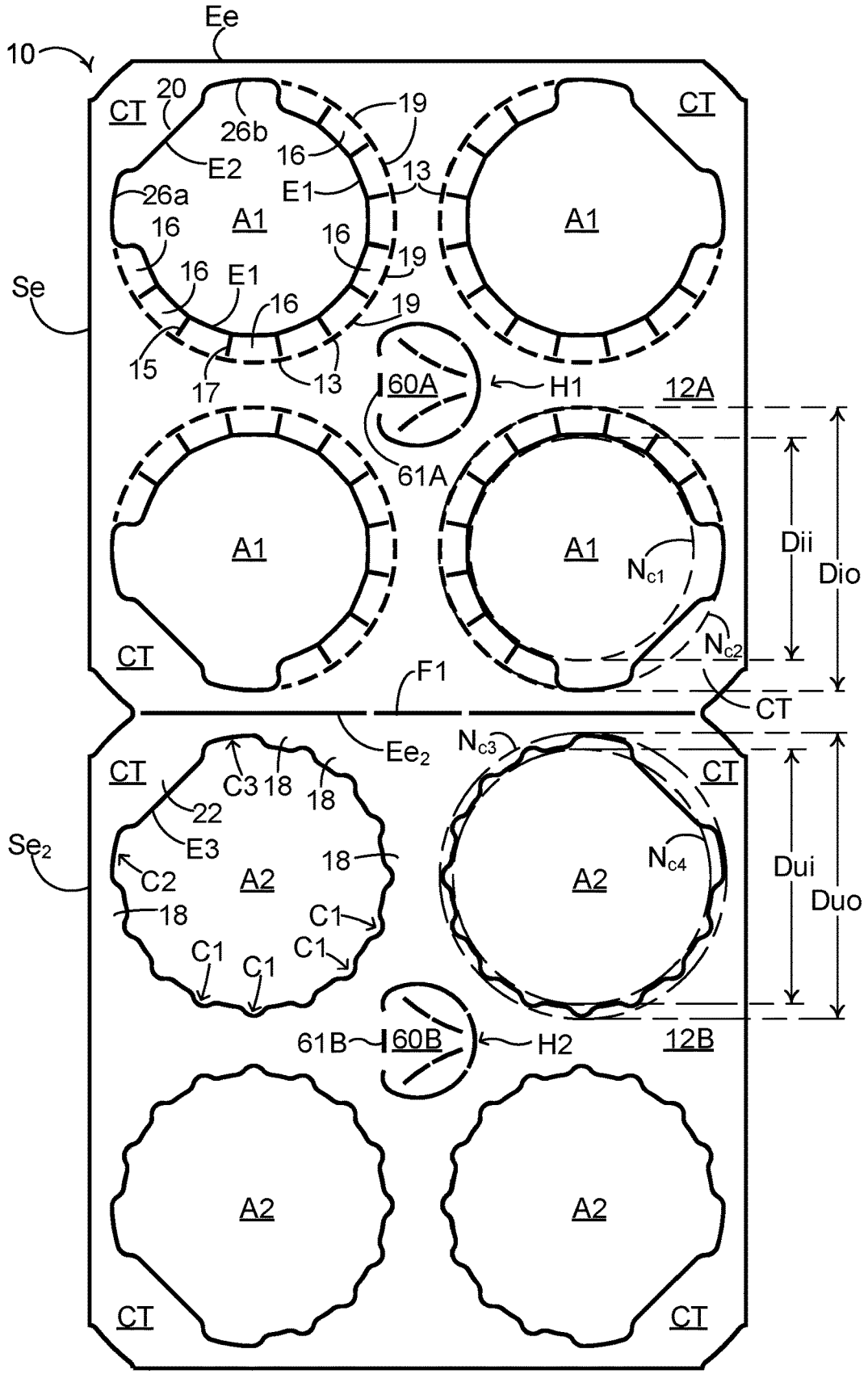
FIG. 4 is a plan view from above of one of the blanks of FIG. 1.
Figure 6:
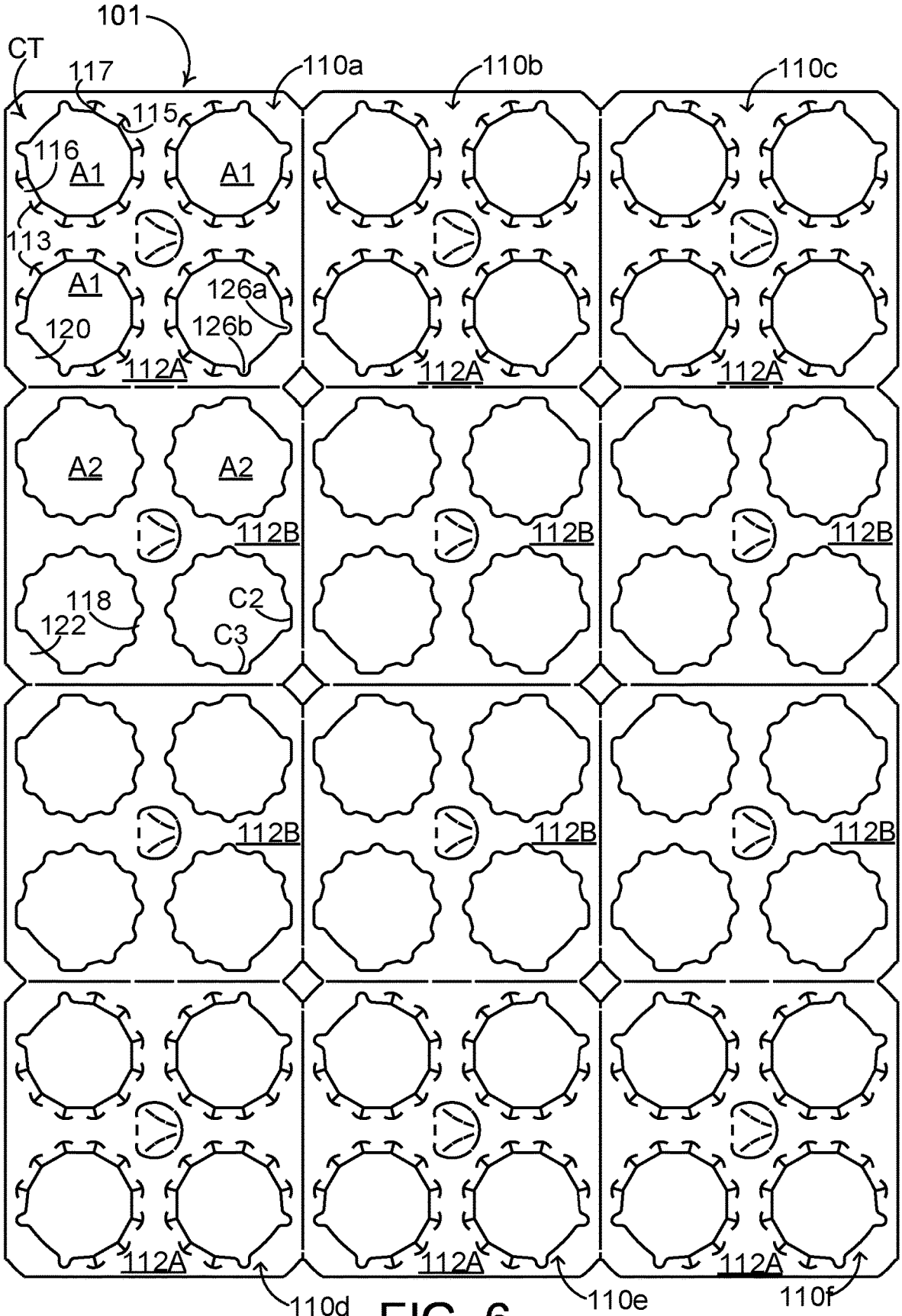
FIG. 6 is a plan view from above of a plurality of blanks, each capable of forming an article carrier according to a second embodiment, connected together in an array.
Figure 7:
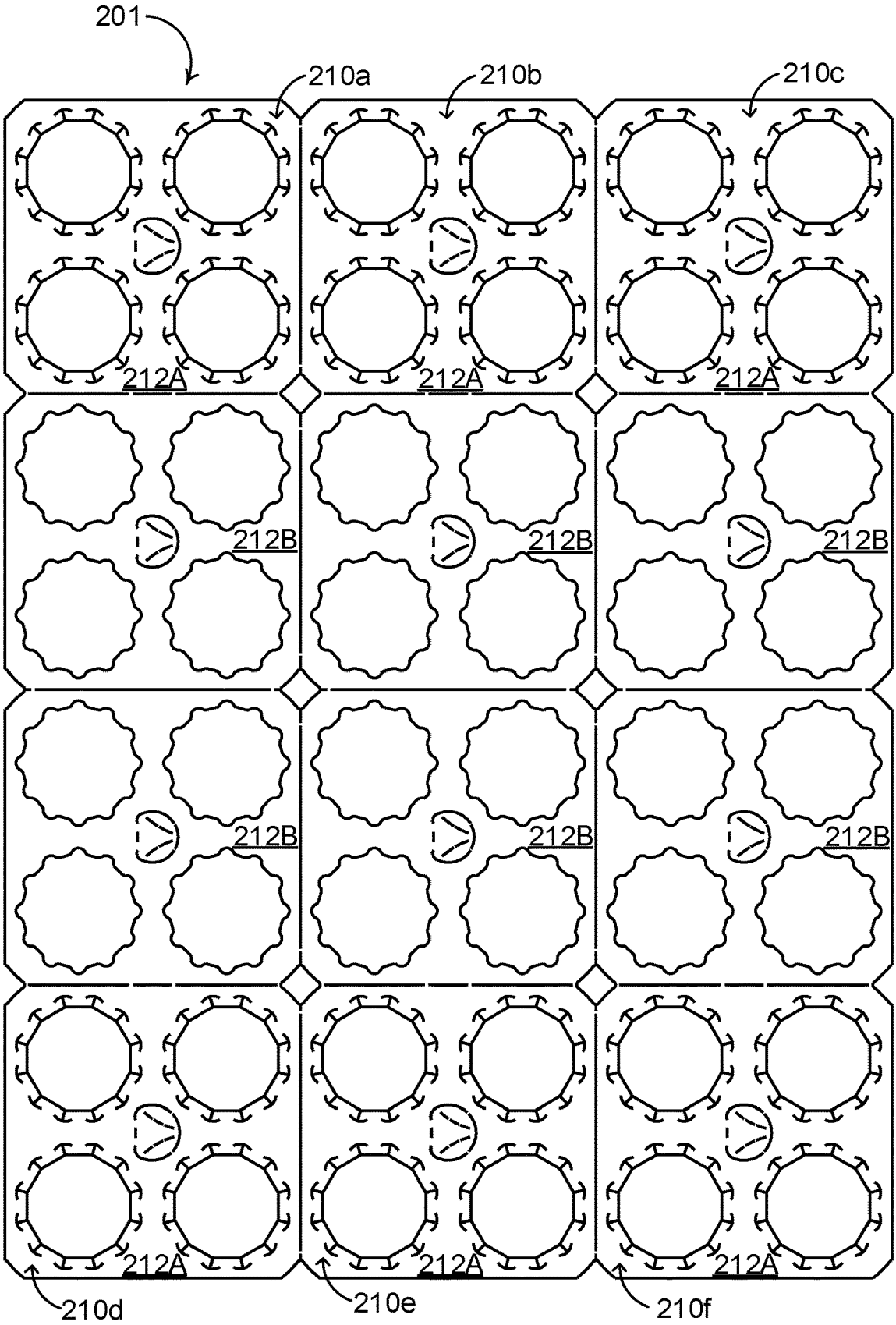
FIG. 7 is a plan view from above of a plurality of blanks, each capable of forming an article carrier according to a third embodiment, connected together in an array.

Referring to FIG. 1, there is shown a plan view of a plurality of connected blanks 10*a* to 10*f* referred to generally by reference sign 1; an individual blank 10 is shown in FIG. 4 which is capable of forming a carton or carrier 90, as shown in FIG. 2, for containing and carrying a group of primary products such as, but not limited to, bottles or cans, hereinafter referred to as articles B, as shown in FIG. 2. The blank 10 forms a secondary package for packaging at least one primary product container or package. Alternative blanks 110*a*-110*f*; 210*a*-210*f* are shown in FIGS. 6 and 7.

In the embodiments detailed herein, the terms "carton" and "carrier" refer, for the non-limiting purpose of illustrating the various features of the invention, to a container for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminum cans), tins, pouches, packets and the like.

The blanks 10*a*-10*f*; 110*a*-110*f*; 210*a*-210*f* are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

The packaging structures or cartons described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiments, the blanks 10*a*-10*f*; 110*a*-110*f*; 210*a*-210*f* are configured to form a carton or carrier 90 for packaging an exemplary arrangement of exemplary articles B. In the embodiment illustrated, the arrangement is a 2×2 matrix or array; two rows of two articles are provided, and the articles B are beverage cans. Alternatively, the blanks 10*a*-10*f*; 110*a*-110*f*; 210*a*-210*f* can be configured to form a carrier for packaging other types, number and size of articles and/or for packaging articles in a different arrangement or configuration.

Referring to FIG. 1 there is shown a plurality of connected blanks 1, specifically there are six blanks 10*a*, 10*b*, 10*c*, 10*d*, 10*e*, 10*f* arranged in a 2×3 matrix or array. Each blank 10*a*, 10*b*, 10*c*, 10*d*, 10*e*, 10*f* comprises a pair of main panels 12A, 12B for forming a top wall or engaging panel 12A/12B of a carrier 90 (see FIG. 2). Each blank 10*a*, 10*b*, 10*c*, 10*d*, 10*e*, 10*f* is connected to at least two adjacent blanks 10 by frangible connections F2.

The pair of main panels 12A, 12B comprises a first main panel 12A for forming a lower layer or ply of the carrier 90 and a second main panel 12B for forming an upper layer or ply of the carrier 90. Each first main panel 12A is hingedly connected to a respective second main panel 12B by a hinged connection in the form of a fold line F1.

Figure 5:
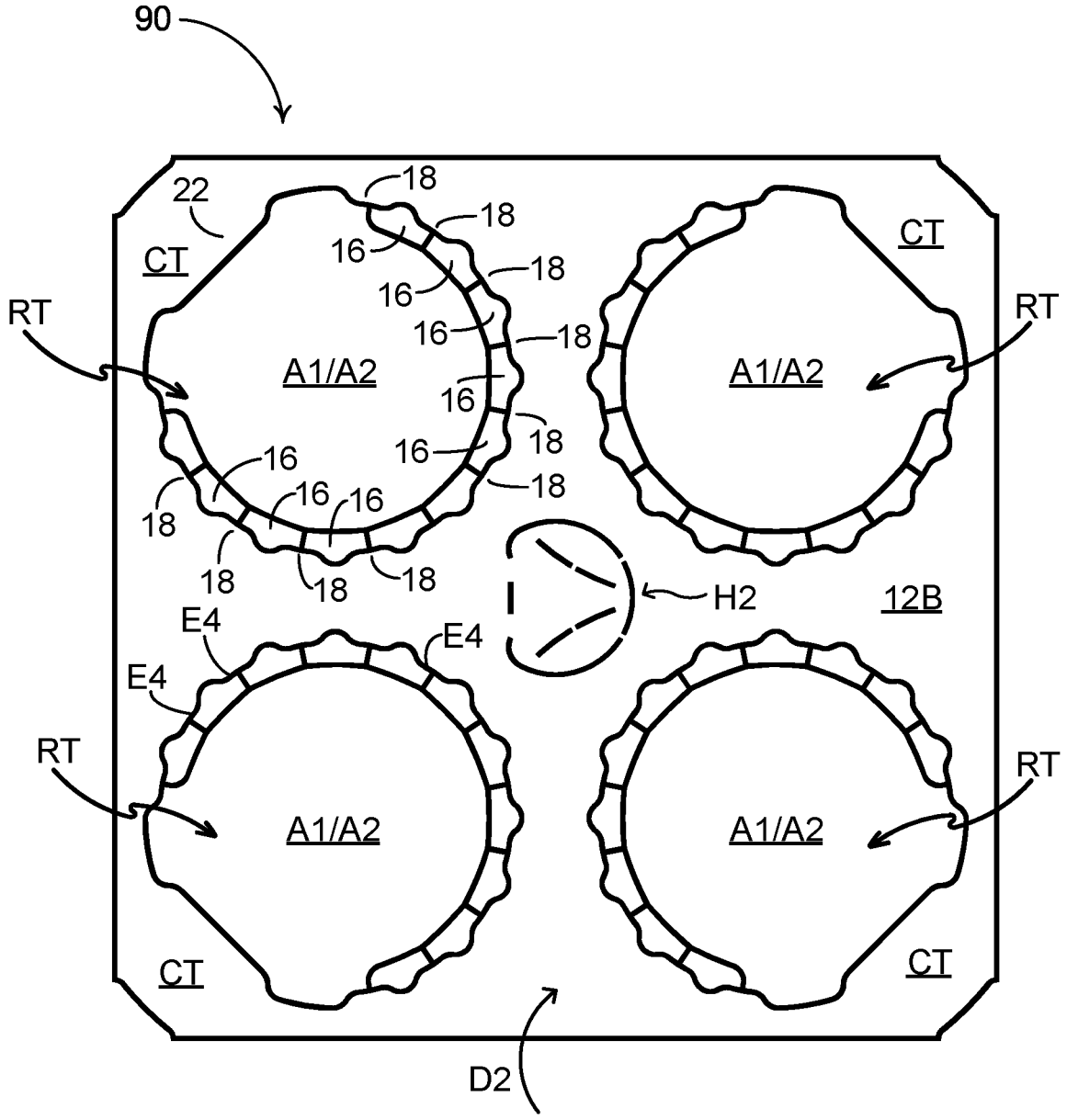
FIG. 5 is a plan view from above of a stage of construction the blank of FIG. 4 into a carrier.

The pair of main panels 12A, 12B includes at least one article retention structure RT, see FIG. 5. In the embodiment of FIGS. 1 to 5 the engaging panel 12A/12B comprises a plurality of article retention structures RT, specifically four article retention structures RT arranged in 2×2 matrix or array. Each of the article retention structures RT comprises an aperture A1/A2.

The article retention structure RT comprises an article receiving opening defined in part by a first aperture A1 defined in, or struck from, the first main panel 12A.

The article receiving opening is defined in part by a second aperture A2 defined in, or struck from, the second main panel 12B.

The article retention structures RT comprise a plurality of teeth or tabs 16, 18 disposed about the aperture A1/A2.

Referring to FIG. 4 there is shown a plan view of a blank 10, the first main panel 12A comprises a first plurality of teeth 16 (also referred to herein as inner or lower teeth 16) disposed about a part of the circumference or border of the first aperture A1. The first plurality of teeth 16 are provided by the first main panel 12A. Each of the lower teeth 16 is hingedly connected to the first main panel 12A, by hinged connection. The hinged connection is defined by a plurality of cut lines 13, 19. The plurality of cut lines 13, 19 may be arranged as an annular series of cuts about the first aperture A1.

The plurality of cut lines 13, 19 may define or approximate a portion of circle.

Each of the plurality of first teeth 16 comprises an engaging edge E1 opposing a hinged edge. The engaging edges E1 are defined by a linear portion of a cut line defining the aperture A1. Each engaging edge E1 defines a part of a polygon. The illustrated embodiment comprises eleven lower teeth 16 together defining a substantial portion of a hexadecagon. Each lower tooth 16 comprises a pair of side edges, the side edges are defined by cut lines 15, 17 extending radially outward from respective vertices of the hexadecagon. That is to say from a respective vertex between a pair of adjacent linear portions of the cut line defining the portion of a hexadecagon. The cut lines 15, 17 are divergently arranged with respect to each other and define an angle therebetween, the angle may be about 22.5°.

The plurality of cut lines 13, 19 comprises a plurality of first circumferential cut lines 13. Each of the plurality of first circumferential cut lines 13 is aligned with one of the radial cut lines 15, 17 such that said one of the radial cut lines 15, 17, or a notional extension thereof, bisects a respective one of the plurality of first circumferential cut lines 13.

Each of the plurality of first circumferential cut lines 13 is spaced apart from said one of the radial cut lines 15, 17 bisecting it so as to define a connecting nick or bridge portion between a pair of adjacently disposed lower teeth 16.

Each of the plurality of first circumferential cut lines 13 may be linear in shape.

The article retention structures RT comprise a plurality of second circumferential cut lines 19. Each of the plurality of second circumferential cut lines 19 is disposed between a pair of the plurality of first circumferential cut lines 13 and is spaced apart therefrom so as to define a pair of connecting nick or bridge portions between each lower tooth 16 and the first main panel 12A. The pair of connecting nick or bridge portions provide a hinged or foldable connection between each lower tooth 16 and the first main panel 12A.

Each of the plurality of second circumferential cut lines 19 may be linear in shape.

In alternative embodiments each of the plurality of first circumferential cut lines 13 may be arcuate or curved. The first circumferential cut lines 13 may comprise a radius of curvature which is equal to half the diameter of the article receiving openings. The first circumferential cut lines 13 may comprise a radius of curvature which is greater than half the article receiving openings.

In alternative embodiments each of the plurality of second circumferential cut lines 19 may be arcuate or curved. The second circumferential cut lines 19 may comprise a radius of curvature which is equal to half the diameter of the article receiving openings. The second circumferential cut lines 19 may comprise a radius of curvature which is greater than half the diameter of the article receiving openings.

The first plurality of teeth 16 is interrupted by at least one recess or cutaway 26*a*, 26*b*. A first recess 26*a* is provided at a location about the circumference of the first aperture A1 disposed in closest proximity to a side edge Se of the first main panel 12A. A second recess 26*b* is provided at a location about the circumference of the first aperture A1 disposed in closest proximity to an end edge Ee of the first main panel 12A. A single second lower tooth 20 may be provided between the first recess 26*a* and the second recess 26*b*. The second lower tooth 20 is defined in part by the first recess 26*a* and in part by the second recess 26*b*.

The second lower tooth 20 is located in or at a corner region of the first main panel 12A. The second lower tooth 20 is part of a corner tab CT, the corner tab CT is foldable out of the plane of the first main panel 12A. A first foldable region may be defined between the first recess 26*a* and the side edge Se. A second foldable region may be defined between the second recess 26*b* and the end edge Ee.

The second lower tooth 20 comprises a lower engaging edge E2 for engaging with an article B. The lower engaging edge E2 may be linear in shape; alternatively it may be non-linear or arcuate. The second lower tooth 20 may occupy a larger portion of the circumference of the article receiving openings than each of the lower teeth 16.

The second main panel 12B comprises a second plurality of teeth 18 (also referred to herein as outer or upper teeth 18) disposed about a part of the circumference or border of the second aperture A2. The second plurality of teeth 18 are provided by the second main panel 12B. Each of the upper teeth 18 is foldably or deformably coupled or connected to the second main panel 12B. In some embodiments a hinged connection may be provided by a fold, crease, score or other suitable device. In the illustrated embodiment the upper teeth 18 are integral with the second main panel 12B, that is to say they have an uninterrupted connection thereto—no fold or other hinge defining device is provided.

The illustrated embodiment comprises twelve upper teeth 18. Each upper tooth 18 is defines in part by a cutaway C1 in the form or a notch or recess. The cutaways C1 are substantially "U" shaped. The cutaways C1 define an arcuate free edge of the second main panel 12B; the arcuate edge has a radius of curvature much less than the radius of curvature of the article receiving opening.

The second plurality of teeth 18 is interrupted by at least one recess or cutaway C2, C3. A third recess C2 is provided at a location about the circumference of the second aperture A2 disposed in closest proximity to a side edge $Se_2$ of the second main panel 12B. A fourth recess C3 is provided at a location about the circumference of the second aperture A2 disposed in closest proximity to an end edge $Ee_2$ of the second main panel 12B. A single second upper tooth 22 may be provided between the third recess C2 and the fourth recess C3. The second upper tooth 22 is defined in part by the third recess C2 and in part by the fourth recess C3.

The second upper tooth 22 is located in or at a corner region of the second main panel 12B. The tooth 22 is part of a corner tab CT, the corner tab CT is foldable out of the plane of the second main panel 12B. A third foldable region may be defined between the third recess C2 and the side edge $Se_2$. A fourth foldable region may be defined between the fourth recess C3 and the end edge $E_{e2}$.

The second upper tooth 22 comprises an upper engaging edge E3 for engaging with an article B. The upper engaging edge E3 may be linear in shape; alternatively it may be non-linear or arcuate. The second upper tooth 22 may occupy a larger portion of the circumference of the article receiving openings than each of the upper teeth 18.

The second upper tooth 22 is arranged to be in registry with the first lower tooth 20 when the second main panel 12B is folded about fold line F2 to be in face contacting relationship with the first main panel 12A, as shown in FIG. 5.

The third recess C2 is arranged to be in registry with the first recess 26*a*. The fourth recess C3 is arranged to be in registry with the second recess 26*b*. In this way the third foldable region is in registry with the first foldable region and the second foldable region is in registry with the fourth foldable region.

The lower teeth 18 of the first plurality of teeth 16 are circumferentially offset from the upper teeth 18 of the second plurality of teeth 18, best illustrated in FIG. 5. Each of the lower teeth is in an overlapping relationship with two adjacently disposed upper teeth 18. The upper teeth 18 each comprises a free edge E4 defined between a pair of recesses C1, C2, C3.

The upper teeth 18 are shorter in height than the lower teeth 16. The lower teeth 16 have larger radial dimension than the upper teeth 18. In this way the first aperture A1 comprises a smaller radius than the second aperture A2, best shown in FIG. 5.

Each of the upper teeth 18 may have the effect of applying a load or force upon at least one side edges of a lower tooth 16. All but the endmost upper teeth in the series or plurality of teeth 18 may have the effect of applying a load or force upon a side edge of each of a pair of adjacent lower teeth 16.

In this way the upper teeth 18 may encourage the lower teeth 16 towards the article B when in use. The offset arrangement may also encourage the lower teeth 16 to bend or deform about the article B. The lower teeth 16 may adopt a curved or arcuate shape complementary to the outer wall of the article B. In this way a greater extent of the engaging edge E1 of the lower teeth 16 may be held in engagement beneath a flange or other projection provide by the article B. The cutaways C1 between the upper teeth 18 may facilitate the lower teeth 16 adopting a non-planar shape, providing a region of each lower tooth 16 over which a lower force or load is exerted an may create a space for a central or intermediate region of each lower tooth 16 to deform or fold into—acting as a guide or mandrel.

The blank 10 may optionally comprise a handle structure. The handle structure may comprise a first handle opening H1 provided in the first main panel 12A and a second first handle opening H2 provided in the second main panel 12B. The first handle opening H1 is struck from or defined in region of the first main panel 12A between a pair of first apertures A1 and a second pair of first apertures A1. The second first handle opening H2 is struck from or defined in region of the second main panel 12B between a pair of second apertures A2 and a second pair of second apertures A2. The first handle opening H1 may be defined, at least in part, by a first finger tab 60A hingedly connected to the first main panel 12A by fold line 61A. The second handle opening H2 may be defined, at least in part, by a second finger tab 60B hingedly connected to the second main panel 12B by fold line 61B. The first handle opening H1 and second first handle opening H2 are arranged to be in registry with each other when the second main panel 12B is folded about fold line F2 to be in face contacting relationship with the first main panel 12A.

Each of the first and second finger tabs 60A, 60B may comprise a pair of fold or crease lines. The fold lines may be divergently arranged with respect to each other. Each of the fold lines may be arcuate in shape.

The blank 10 includes at least a paperboard substrate. The material of the paperboard substrate may be selected from any conventional paperboard, for example, ranging in weight upwardly from about 10 pt., preferably from about 16 pt. to about 28 pt. (0.028"/~0.7 mm). An example of such a substrate is a 20 point (pt.) (0.020"/~0.5 mm) SBS board (solid bleached sulfate paperboard coated on one side, trade name PrintKote®) or CNK® board (Coated Natural Kraft®—an unbleached kraft paperboard having a clay coating on one side, trade name CarrierKote™) manufactured by WestRock® Company. The paperboard substrate may be a bleached or unbleached board. The board may be coated on at least one side, optionally the side opposite the lamination, with a conventional coating selected for compatibility with the printing method and board composition.

The blank 10 may include a tear resistant layer laminated to the paperboard layer. It optionally includes an adhesive layer between the paperboard substrate and the tear resistant layer. The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g. MYLAR®, which is a bi-axially oriented polyester, oriented nylon, cross-laminated polyolefin or high density polyolefin. The orientation and cross-laminated structure of these materials contribute to the tear resistant characteristic. Also, tear resistance may be attributed to the chemical nature of the tear resistant material such as extruded metallocene-catalyzed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low-density polyethylene (LDPE). The adhesive layer may be placed between the substrate and the tear resistant layer to secure the tear resistant layer to the substrate.

Turning to the construction of the carrier 90 from the blank 10, glue or other adhesive treatment is applied to a surface of one or both of the first and second main panels 12A, 12B. The blank 10 is folded about fold line F1 to bring the first main panel 12A into face contacting relationship with the second main panel 12B. The first main panel 12A is secured to the second main panel 12B.

In the case of the plurality of connected blanks 1 the blanks 10*a* to 10*c* may be folded simultaneously and the blanks 10*d* to 10*f* may be folded simultaneously. In this way a plurality of connected carriers 90 is formed.

The blank 10 may be applied to a group of articles B. The blank 10 is lowered with respect to the group of articles B. Each of the article retention structures RT of the blank 10 is aligned with a respective article B in the group. Portions of the articles B pass through the engaging panel 12A/12B. The lower teeth 16 are folded out of the plane of the first main panel 12A, the upper teeth 18 may be deformed or displaced out of the plane of the second main panel 12B.

The engaging edges E1 of the lower teeth 16 engage beneath a projection. The projection may be located about the neck or chime (which may provide a flange) of an article B. When the article B is can the projection may be provided by a canner's end seam. In other embodiments it may be provided by a ridge or undercut shaping of the article B or by an end closure of the article B for example but not limited to a crown cork or closure. In this way, the engaging edges E1 grip or hold the article B and prevent or inhibit the article B from unintentionally separating from the main panel 12. The assembled carrier 90 is shown in FIG. 2.

Figure 8:
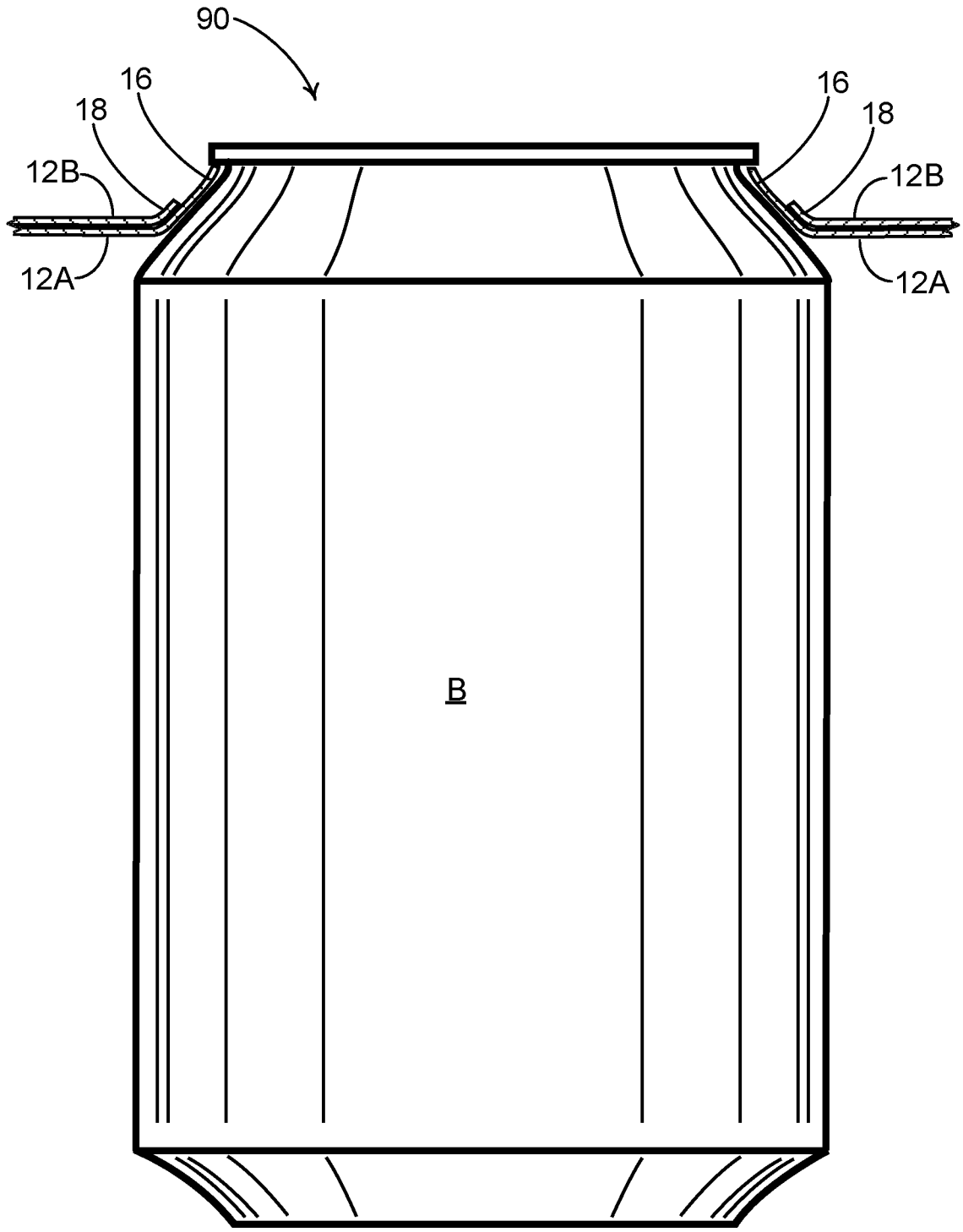
FIG. 8 is cutaway view of a portion of a package comprising the carrier of FIG. 2 and an article.

FIG. 8 shows a partial view of the carrier 90, a section of the carrier has been shown in section to illustrate that the lower teeth 16 deform upwardly and engage beneath a flange of the article B. The upper teeth 18 are displaced upwardly and are in close proximity to the lower teeth 16. The upper teeth follow the contour of a portion of the lower teeth 16. The upper teeth 18 do not engage or contact with the article B but rather support or brace the lower teeth 16 against the article B.

Figure 3:
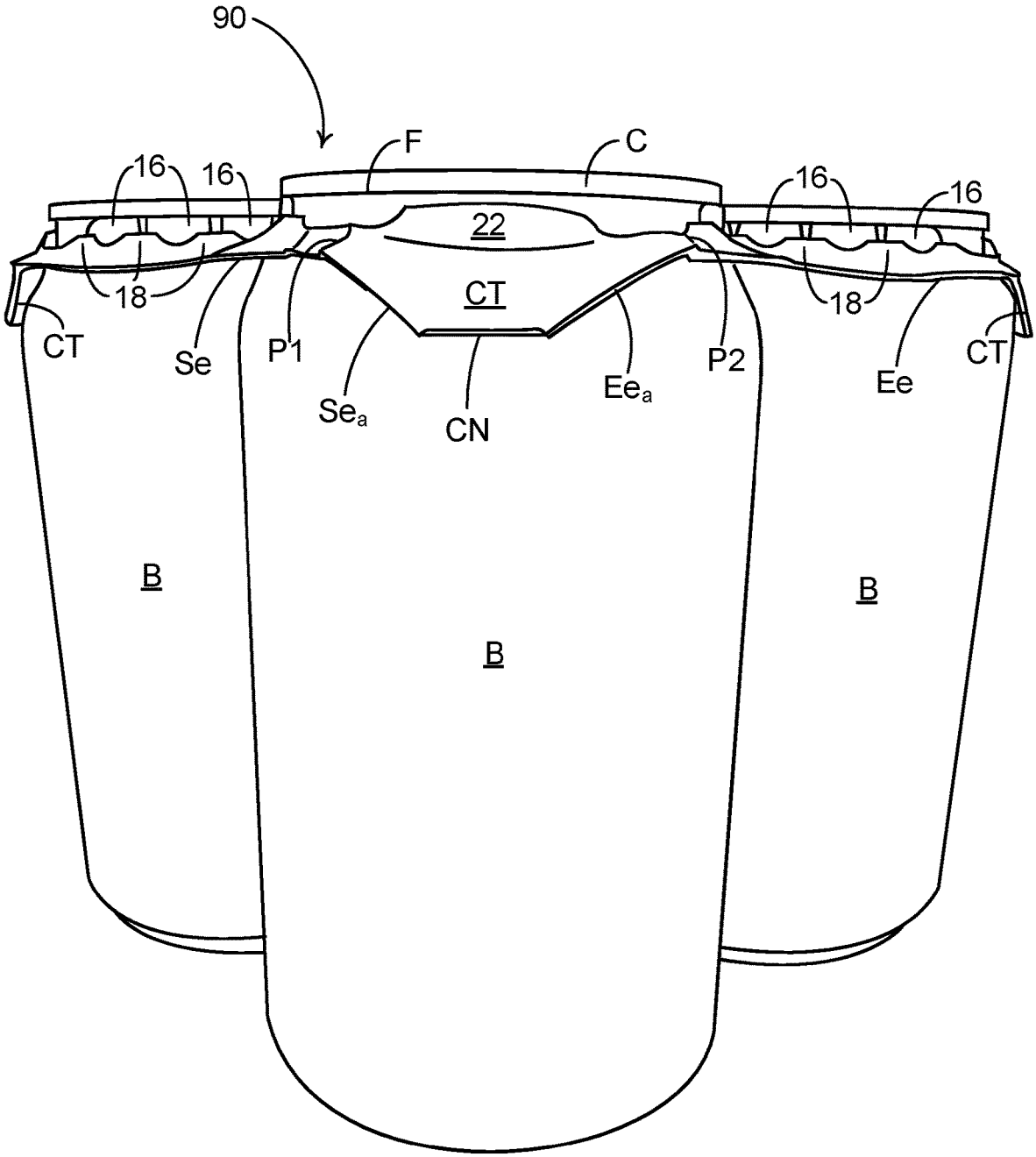
FIG. 3 is an alternative perspective view of the carrier of FIG. 2.

The corner tab CT is folded downwardly about a corner or shoulder of an article B, best illustrated in FIG. 3. The corner tab CT is disposed in close proximity to an adjacent portion of the article B. The corner tab CT may follow the contour of the article B, such that it does not project outwardly beyond the footprint of the article B, or at least not significantly.

The upper and lower second teeth 22, 20 are secured together and engage with flange of the article B. The upper and lower second teeth 22, 20 may fold with respect to the engaging panel 12A/12B of the carrier 90, the degree or angle of the fold may be less than that of the lower and/or upper first teeth 16, 18 since the corner portion of the engaging panel 12A/12B to which they are coupled is folded downwardly.

In some embodiments the upper and lower second teeth 22, 20 may not fold with respect to the corner tab CT. The corner tab CT may adopted or conform to the shape of the article B, folds develop in the foldable regions of the first and second main panels 12A, 12B allowing the corner tab CT to be moved out of the plane of the engaging panel 12A/12B of the carrier 90.

In some embodiments the plurality of carriers is applied simultaneously to a first group of articles B. The first group of articles B is divisible into a plurality of second groups of articles B. Each second group of articles B is thus formed from a subset of the first group of articles B. In the embodiment illustrated in FIG. 1 the first group of articles B comprises twenty-four articles arranged in a 4×6 matrix or array, and each individual blank 10A to 10L accommodates four articles in a 2×2 matrix or array.

The frangible connections F2 between the individual blanks 10 may separate upon application of the plurality of blanks 1 to the first group of articles B. Alternatively, the frangible connections F2 may remain intact, individual blanks 10 may be separated from the others at a point of sale or distribution.

Another optional feature of the carrier 90 is that the engaging panel 12A/12B is defined by a perimeter to which no other part of the carrier 90 is connected. That is to say, the carrier 90 is free of connection to other panels for example, but not limited to, side or end wall panels which extend about the sides of the article group. The perimeter of the engaging panel 12A/12B is therefore defined in its entirety by free, cut or unhinged edges.

Referring now to FIGS. 6 and 7, there are shown additional embodiments of the present disclosure. In the second and third illustrated embodiments like numerals have, where possible, been used to denote like parts, albeit with the addition of the prefix "100", "200" to indicate that these features belong to the second and third embodiments respectively. The additional embodiments share many common features with the first embodiment and therefore only the differences from the embodiment illustrated in FIGS. 1 to 5 will be described in detail.

FIG. 6 illustrates a second embodiment and shows a plurality of connected blanks referred to generally by reference sign 101, specifically there are six blanks 110*a*, 110*b*, 110*c*, 110*d*, 110*e*, 110*f* arranged in a 2×3 matrix or array. Each blank 110*a*, 110*b*, 110*c*, 110*d*, 110*e*, 110*f* comprises a pair of main panels 112A, 112B for forming a top wall or engaging panel of a carrier (not shown). Each blank 110*a*, 110*b*, 110*c*, 110*d*, 110*e*, 110*f* is connected to at least two adjacent blanks 110 by frangible connections.

The pair of main panels 112A, 112B comprises a first main panel 112A for forming a lower layer or ply of the carrier and a second main panel 1128 for forming an upper layer or ply of the carrier. Each first main panel 112A is hingedly connected to a respective second main panel 112B by a hinged connection in the form of a fold line.

The pair of main panels 112A, 112B provide at least one article retention structure. In the embodiment of FIG. 6 each of the blanks 110*a*, 110*b*, 110*c*, 110*d*, 110*e*, 110*f* is arranged to provide a plurality of article retention structures, specifically four article retention structures arranged in 2×2 matrix or array.

The article retention structure comprises an article receiving opening defined in part by a first aperture A1 defined in, or struck from, the first main panel 112A.

The article receiving opening is defined in part by a second aperture A2 defined in, or struck from, the second main panel 1128. Each of the second apertures A2 and the plurality of teeth 18 disposed thereabouts is substantially the same in construction, albeit the number teeth disposed about each second aperture A2 is reduced to nine teeth, as described above in relations to the embodiment of FIGS. 1 to 5.

The first aperture A1 comprises a plurality of teeth or tabs 116 disposed thereabouts.

The first main panel 112A comprises a first plurality of teeth 116 (also referred to herein as inner or lower teeth 116) disposed about a part of the circumference or border of the first aperture A1. The first plurality of teeth 116 are provided by the first main panel 112A. Each of the lower teeth 116 is hingedly connected to the first main panel 112A, by hinged connection. The hinged connection is defined by a plurality of cut lines 113. The plurality of cut lines 113 may be arranged as an annular series of cuts about the first aperture A1.

Each of the plurality of lower teeth 116 comprises an engaging edge. The engaging edges may be defined by a linear portion of a cut line defining the first aperture A1. Each engaging edge defines a part of a polygon. The illustrated embodiment comprises ten lower teeth 116 together defining a substantial portion of a dodecagon. Each lower tooth 116 comprises a pair of side edges, the side edges are defined by cut lines 115, 117 extending radially outward from respective vertices of the dodecagon. That is to say from a respective vertex between a pair of adjacent linear portions of the cut line defining the portion of a dodecagon. The cut lines 115, 117 are divergently arranged with respect to each other and define an angle therebetween, the angle may be about 30°.

The plurality of cut lines 113 comprises a plurality of arcuate cut lines 113. Each of the plurality of first circumferential cut lines 113 is aligned with a radial cut line 115, 117 such that said one of the radial cut lines 115, 117, or a notional extension thereof, bisects a respective one of the plurality of arcuate cut lines 113.

Each of the plurality of first circumferential cut lines 113 is spaced apart from said one of the radial cut lines 115, 117 bisecting it so as to define a connecting nick or bridge portion between a pair of adjacently disposed lower teeth 116.

Each of the cut lines 113 is curvilinear or arcuate in shape. The cutlines 113 have radius of curvature substantially smaller than a radius of curvature of the article receiving opening.

The cut lines 19 of the embodiment of FIG. 1 have been omitted from the embodiment of FIG. 6.

First and second recesses 126*a*, 126*b* have been reduced in dimension compared to the first and second recesses 26*a*, 26*b* of the embodiment of FIG. 1, specifically the first and second recesses 126*a*, 126*b* of FIG. 6 occupy a smaller arc or portion of the circumference of the article receiving opening.

The plurality of lower teeth 116 are offset, circumferentially, with respect to the plurality of upper teeth 118. The plurality of lower teeth 116 occupy a larger sector of the article receiving opening than the plurality of upper teeth 118. (In the embodiment of FIG. 1 the plurality of upper teeth 118 occupy a larger sector of the article receiving opening than the plurality of lower teeth 116.)

FIG. 7 illustrates a third embodiment and shows a plurality of connected blanks referred to generally by reference sign 201, specifically there are six blanks 210*a*, 210*b*, 210*c*, 210*d*, 210*e*, 210*f* arranged in a 2×3 matrix or array. Each blank 210*a*, 210*b*, 210*c*, 210*d*, 210*e*, 210*f* comprises a pair of main panels 212A, 212B for forming a top wall or engaging panel of a carrier (not shown). Each blank 210*a*, 210*b*, 210*c*, 210*d*, 210*e*, 210*f* is connected to at least two adjacent blanks 210 by frangible connections.

The pair of main panels 212A, 212B comprises a first main panel 212A for forming a lower layer or ply of the carrier and a second main panel 212B for forming an upper layer or ply of the carrier. Each first main panel 212A is hingedly connected to a respective second main panel 212B by a hinged connection in the form of a fold line.

The pair of main panels 212A, 212B provide at least one article retention structure. In the embodiment of FIG. 7 each of the blanks 210*a*, 210*b*, 210*c*, 210*d*, 210*e*, 210*f* is arranged to provide a plurality of article retention structures, specifically four article retention structures arranged in 2×2 matrix or array.

In the embodiment of FIG. 7 the article retention structures are substantially similar in construction to the article retention structure of the embodiment of FIG. 6, albeit the first and second recesses 126*a*, 126*b* have been omitted from the first apertures A1. The third and fourth recesses C2, C3 have been omitted from the second apertures A2 and the second upper and lower teeth 122, 120 have also been omitted. In this way the plurality of lower teeth 216 extend about the entire circumference of the first apertures A1 and the plurality of upper teeth 218 extend about the entire circumference of the second apertures A2. The upper teeth 218 are circumferentially offset with respect to the lower teeth 216 such that each lower tooth is in partial overlapping relationship with two adjacent upper teeth 218.

The present disclosure provides a carrier 90 of the top engaging type having improved article retention structures or article top engaging devices RT.

The article top engaging device RT comprises an engaging panel 12A/12B having at least one top-receiving opening.

A package comprises at least one article B and an article carrier 90. The article carrier 90 comprises an engaging panel 12A/12B which comprises at least one article-receiving aperture RT disposed in engagement with a part of the at least one article B. The engaging panel 12A/12B has a first side edge Se, a first end edge Ee, a corner CN defined by the first side and end edges and a corner area CT. The article-receiving aperture RT comprises a first engaging edge E2 at a position across the corner area CT from the corner CN. The corner area CT is defined at least partially by the first engaging edge E2, an end portion $Se_a$ of the first side edge Se extending from the corner CN and an end portion $Ee_a$ of the first end edge Ee extending from the corner CN and wherein the corner area CT is folded with respect to the remainder of the engaging panel 12A/12B such that the end portion $Se_a$ of the first side edge Se is angled with respect to an adjoining portion of the first side edge Se.

The end portion $Ee_a$ of the first end edge Ee is angled with respect to an adjoining portion of the first end edge Ee.

The corner area CT is further defined at least in part by first P1 and second P2 fold lines. The first fold line P1 connects the corner area CT with the remainder of the engaging panel 12A/12B. The second fold line P2 connects the corner area CT with the remainder of the engaging panel 12A/12B.

The first fold line P1 extends from the first side edge Se toward the at least one article-receiving aperture RT and the second fold line P2 extends from the first end edge Ee toward the at least one article-receiving aperture RT.

The present disclosure also provides a package comprising an article carrier 90 and at least one article B, in which the at least one article B has an upwardly tapered upper portion or neck N. The carrier 90 comprises an engaging panel 12A/12B; 112A/112B; 212A/212B comprising a first upper ply 12B; 112B; 212B and a second lower ply 12A; 112A; 212A. The lower ply 12A includes at least one lower aperture A1 having an annular series of lower ply tabs 16; 116; 216 formed around the at least one lower aperture A1. The lower ply tabs 16; 116; 216 are angled upwardly with respect to the engaging panel 12A/12B; 112A/112B; 212A/212B such that the lower ply tabs 16; 116; 216 are in face-contacting engagement with the upper portion N of the at least one article B. The upper ply 12B; 112B; 212B includes at least one upper aperture A2 substantially coaxial with the at least one lower aperture A1 and having an annular series of upper ply tabs 18; 118; 218 formed around the at least one upper aperture A2. The upper ply tabs 18; 118; 218 are angled upwardly with respect to the engaging panel 12A/12B; 112A/112B; 212A/212B such that at least some of the upper ply tabs 18; 118; 218 each is in face-contacting engagement with a respective adjacent pair of the lower ply tabs 16; 116; 216.

The lower ply tabs 16; 116; 216 each have a base and an inner edge E1 opposite said base. The at least one lower aperture A1 has a notional lower outer circle $N_{c2}$ defined by the bases of lower ply tabs 16; 116; 216. The notional lower outer circle $N_{c2}$ has a lower outer circle diameter Dio. The upper ply tabs 18; 118; 218 each have a base and an inner edge opposite said base of each upper ply tab 18; 118; 218. The at least one upper aperture A2 has a notional upper outer circle $N_{c3}$ defined by the bases of the upper ply tabs 18; 118; 218. The notional upper outer circle $N_{c3}$ has an upper outer circle diameter Duo. The upper outer circle diameter Duo is equal to or less than the lower outer circle diameter Dio.

The at least one lower aperture A1 has a notional lower inner circle $N_{c1}$ defined by the inner edges E1 of the lower ply tabs 16; 116; 216. The notional lower inner circle $N_{c1}$ has a lower inner circle diameter Dii. The at least one upper aperture A2 has a notional upper inner circle defined by the inner edges of the upper ply tabs 18; 118; 218. The notional upper inner circle $N_{c1}$ has an upper inner circle diameter Dui. The upper inner circle diameter Dui is greater than the lower inner circle diameter Dii.

Each of the upper ply tabs 18; 118; 218 is spaced apart by a recess C1 from an adjacent one of the upper ply tabs 18; 118; 218. At least some of each of the recesses C1 is aligned with a respective one of the lower ply tabs 18; 118; 218.

A carrier 90 is disclosed herein that comprises an engaging panel 12A/12B; 112A/112B; 212A/212B comprising a first upper ply 12B; 112B; 212B and a second lower ply 12A; 112A; 212A. The lower ply 12A includes at least one lower aperture A1 having an annular series of first lower ply tabs 16; 116; 216 formed around a first portion of the at least one lower aperture A1 and at least one second lower tab 20 formed around a second portion of the at least one lower aperture A1. The upper ply 12B; 112B; 212B includes at least one upper aperture A2 substantially coaxial with the at least one lower aperture A1 and having an annular series of first upper ply tabs 18; 118; 218 formed around a first portion of the at least one upper aperture A2 and at least one second upper tab 22 formed around a second portion of the at least one upper aperture A2.

The first lower ply tabs 16; 116; 216 are offset with respect to the first upper ply tabs 18; 118; 218.

The first lower ply tabs 16; 116; 216 are offset circumferentially with respect to the first upper ply tabs 18; 118; 218. A cutline 15, 17; 115,117 separating the first lower ply tabs 16; 116; 216 from each other substantially bisects one of the first upper ply tabs 18; 118; 218.

The first lower ply tabs 16; 116; 216 are offset radially with respect to the first upper ply tabs 18; 118; 218. The inner edges E1 of the first lower ply tabs 16; 116; 216 are inset with respect to the inner edges of the first upper ply tabs 18; 118; 218.

The at least one second lower tab 20 is aligned in registry with the at least one second upper tab 22 to form a common engaging edge E2/E3. The at least one second lower tab 20 is aligned in circumferentially and radially with respect to the at least one second upper tab 22.

The first lower ply tabs 16; 116; 216 are angled upwardly with respect to the engaging panel 12A/12B; 112A/112B; 212A/212B such that the lower ply tabs 16; 116; 216 are in face-contacting engagement with the upper portion N of the at least one article B. The upper ply tabs 18; 118; 218 are angled upwardly with respect to the engaging panel 12A/12B; 112A/112B; 212A/212B such that at least some of the upper ply tabs 18; 118; 218 each is in face-contacting engagement with a respective adjacent pair of the lower ply tabs 16; 116; 216.

The article carrier 90 comprises an engaging panel 12A/12B; 112A/112B; 212A/212B comprising a first upper ply 12B; 112B; 212B and a second lower ply 12A; 112A; 212A secured together in face contacting arrangement.

It will be recognized that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, embossed lines, debossed lines, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A package comprising at least one article and an article carrier, the article carrier comprising an engaging panel having at least one article-receiving aperture disposed in engagement with a part of the at least one article, the engaging panel comprising a first side edge, a first end edge, a corner defined by the first side and end edges and a corner area, wherein the article-receiving aperture comprises a first engaging edge at a position across the corner area from the corner, the corner area is defined at least partially by the first engaging edge, an end portion of the first side edge extends from the corner and an end portion of the first end edge extends from the corner and wherein the corner area is folded with respect to the remainder of the engaging panel such that the end portion of the first side edge is angled with respect to an adjoining portion of the first side edge.

2. A package according to claim 1 wherein the end portion of the first end edge is angled with respect to an adjoining portion of the first end edge.

3. A package according to claim 1 wherein the corner area is further defined at least in part by first and second fold lines, the first fold line connects the corner area with the remainder of the engaging panel, and the second fold line connects the corner area with the remainder of the engaging panel.

4. A package according to claim 3 wherein the first fold line extends from the first side edge toward the at least one article-receiving aperture and the second fold line extends from the first end edge toward the at least one article-receiving aperture.

5. A package according to claim 1 wherein the at least one article having an upwardly tapered upper portion, wherein the engaging panel comprising a first, upper, ply and a second, lower, ply, the lower ply including at least one lower aperture having an annular series of lower ply tabs formed around the at least one lower aperture, wherein the lower ply tabs are angled upwardly with respect to the engaging panel such that the lower ply tabs are in face-contacting engagement with the upper portion of the at least one article, the upper ply includes at least one upper aperture arranged substantially coaxially with the at least one lower aperture and has an annular series of upper ply tabs formed around the at least one upper aperture, the upper ply tabs are angled upwardly with respect to the engaging panel such that at least some of each of the upper ply tabs is in face-contacting engagement with a respective adjacent pair of the lower ply tabs.

6. A package according to claim 5 wherein the lower ply tabs each has a base and an inner edge opposite said base, the at least one lower aperture has a notional lower outer circle defined by the bases of lower ply tabs, the notional lower outer circle has a lower outer circle diameter, and wherein the upper ply tabs each has a base and an inner edge opposite said base of each upper ply tab, the at least one upper aperture has a notional upper outer circle defined by the bases of the upper ply tabs, the notional upper outer circle has an upper outer circle diameter, and wherein the upper outer circle diameter is equal to or less than the lower outer circle diameter.

7. A package according to claim 6 wherein the at least one lower aperture has a notional lower inner circle defined by the inner edges of the lower ply tabs, the notional lower inner circle has a lower inner circle diameter, wherein the at least one upper aperture has a notional upper inner circle defined by the inner edges of the upper ply tabs, the notional upper inner circle has an upper inner circle diameter, and wherein the upper inner circle diameter is greater than the lower inner circle diameter.

8. A package according to claim 5 wherein each of the upper ply tabs is spaced apart by a recess from an adjacent one of the upper ply tabs and wherein at least some of the recesses each is aligned with a respective one of the lower ply tabs.

9. An article carrier for packaging one or more articles, the article carrier comprising an engaging panel comprising a first upper ply and a second lower ply secured together in face contacting arrangement, the upper ply including at least one upper aperture having an annular series of upper ply tabs formed around the at least one upper aperture, the upper ply tabs each having a base and an inner edge opposite said base, wherein the upper ply tabs are folded upwardly with respect to the engaging panel when a portion of at least one article is received in the at least one upper aperture, the lower ply includes at least one lower aperture substantially coaxial with the at least one upper aperture, the at least one lower aperture has an annular series of lower ply tabs formed around the at least one lower aperture, wherein the lower ply tabs each has a base and an inner edge opposite said base of each lower ply tab, the at least one lower aperture has a notional lower outer circle defined by the bases of lower ply tabs, the notional lower outer circle has a lower outer circle diameter, wherein the upper ply tabs each has a base and an inner edge opposite said base of each upper ply tab, the at least one upper aperture has a notional upper outer circle defined by the bases of the upper ply tabs, the notional upper outer circle has an upper outer circle diameter, and wherein the upper outer circle diameter is equal to or less than the lower outer circle diameter.

10. An article carrier according to claim 9 wherein the at least one lower aperture has a notional lower inner circle defined by the inner edges of the lower ply tabs, the notional lower inner circle has a lower inner circle diameter, wherein the at least one upper aperture has a notional upper inner circle defined by the inner edges of the upper ply tabs, the notional upper inner circle has an upper inner circle diameter, and wherein the upper inner circle diameter is greater than the lower inner circle diameter.

11. An article carrier according to claim 9 wherein each of the upper ply tabs is spaced apart from an adjacent one of the upper ply tabs by a recess and wherein at least some of the recesses each is aligned with a respective one of the lower ply tabs.

12. A carrier according to claim 9, wherein the annual series of lower ply tabs having a series of first lower ply tabs formed around a first portion of the at least one lower aperture and at least one second lower tab formed around a second portion of the at least one lower aperture, and wherein the annual series of upper ply tabs having a series of first upper ply tabs formed around a first portion of the at least one upper aperture and at least one second upper tab formed around a second portion of the at least one upper aperture, wherein the first lower ply tabs are offset with respect to the first upper ply tabs and wherein the at least one second lower tab is aligned in registry with the at least one second upper tab.

13. A carrier according to claim 12 wherein the first lower ply tabs are offset circumferentially with respect to the first upper ply tabs.

14. A carrier according to claim 13 wherein a cutline which separates two adjacently disposed ones of the first lower ply tabs from each other substantially bisects one of the first upper ply tabs.

15. A carrier according to claim 13 wherein the first lower ply tabs are offset radially with respect to the first upper ply tabs.

16. A carrier according to claim 15 wherein inner edges of the first lower ply tabs are inset with respect to inner edges of the first upper ply tabs.

17. A carrier according to claim 12 wherein the at least one second lower tab is aligned in registry with the at least one second upper tab so to form a common engaging edge.

18. A carrier according to claim 17 wherein the at least one second lower tab is aligned in circumferentially and radially with respect to the at least one second upper tab.

19. A blank for forming an article carrier, the blank comprising a first panel for forming an upper ply of an engaging panel and a second panel for forming a lower ply of the engaging panel, the second panel including at least one lower aperture having a series of first lower ply tabs formed around a first portion of the at least one lower aperture and at least one second lower tab formed around a second portion of the at least one lower aperture, the first panel including at least one upper aperture arranged to be substantially coaxial with the at least one lower aperture in a setup condition, the first panel having a series of first upper ply tabs formed around a first portion of the at least one upper aperture and at least one second upper tab formed around a second portion of the at least one upper aperture, wherein the first lower ply tabs are arranged to be offset with respect to the first upper ply tabs and wherein the at least one second lower tab is aligned in registry with the at least one second upper tab when the blank is a setup condition.

20. A blank according to claim 19 wherein the second panel being hinged to the first panel for being secured together in face contacting arrangement, wherein the first upper ply tabs each having a base and an inner edge opposite said base, wherein the first upper ply tabs are foldable upwardly with respect to the engaging panel when a portion of at least one article is received in the at least one upper aperture, wherein the first lower ply tabs each has a base and an inner edge opposite said base of each first lower ply tab, the at least one lower aperture has a notional lower outer circle defined by the bases of first lower ply tabs, the notional lower outer circle has a lower outer circle diameter, wherein the first upper ply tabs each has a base and an inner edge opposite said base of each first upper ply tab, the at least one upper aperture has a notional upper outer circle defined by the bases of the first upper ply tabs, the notional upper outer circle has an upper outer circle diameter, and wherein the upper outer circle diameter is equal to or less than the lower outer circle diameter.

* * * * *